US008771014B2

(12) United States Patent
Nakamura et al.

(10) Patent No.: US 8,771,014 B2
(45) Date of Patent: Jul. 8, 2014

(54) CONNECTOR HOUSING WITH MAT SEAL

(75) Inventors: Masatoshi Nakamura, Makinohara (JP); Naoki Goto, Makinohara (JP); Madoka Ooishi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 49 days.

(21) Appl. No.: 13/576,729

(22) PCT Filed: Feb. 4, 2011

(86) PCT No.: PCT/JP2011/052444
§ 371 (c)(1),
(2), (4) Date: Aug. 2, 2012

(87) PCT Pub. No.: WO2011/096548
PCT Pub. Date: Aug. 11, 2011

(65) Prior Publication Data
US 2012/0302094 A1 Nov. 29, 2012

(30) Foreign Application Priority Data
Feb. 4, 2010 (JP) ..... 2010-023118

(51) Int. Cl.
*H01R 13/40* (2006.01)
*H01R 13/52* (2006.01)
*H01R 13/504* (2006.01)
*H01R 43/18* (2006.01)

(52) U.S. Cl.
CPC ..... *H01R 13/5208* (2013.01); *H01R 13/504* (2013.01); *H01R 43/18* (2013.01)
USPC ..... 439/587

(58) Field of Classification Search
USPC ..... 439/271–275, 587–589
See application file for complete search history.

(56) References Cited

U.S. PATENT DOCUMENTS 5,145,410 A * 9/1992 Maejima et al. ..... 439/587
5,618,198 A * 4/1997 Sato et al. ..... 439/274

(Continued)

FOREIGN PATENT DOCUMENTS

JP 2000-21491 A 1/2000
JP 2004-158316 A 6/2004

(Continued)

OTHER PUBLICATIONS

International Search Report PCT/ISA/210, issued by the International Searching Authority in corresponding International Application No. PCT/JP2011/052444 on Mar. 8, 2011.

(Continued)

*Primary Examiner* — Thanh Tam Le
(74) *Attorney, Agent, or Firm* — Sughrue Mion, PLLC

(57) ABSTRACT

A connector housing with a mat seal, includes a connector housing a mat seal. At an outer surface of a rear wall of the connector housing, a plurality of passages for a silicone gum forming material are provided outside an area where a plurality of terminal insertion holes are formed. On the outer surface of the rear wall and outside the passages, an annular rib is protruded and surrounds an area inside the annular rib. The mat seal is molded by using the area inside the annular rib as a reservoir space in which the silicone gum forming material overflowing from the seal forming cavity is retained, and using at least one of the passages as a passage for a gate through which the silicone gum forming material is injected into the seal forming cavity, and the other of the passages as passages for overflow.

1 Claim, 9 Drawing Sheets

(56) References Cited

U.S. PATENT DOCUMENTS

| | | | | |
|---|---|---|---|---|
| 5,632,653 | A * | 5/1997 | Sawada | 439/587 |
| 5,823,811 | A | 10/1998 | Blanchfield et al. | |
| 5,931,699 | A | 8/1999 | Saito | |
| 6,071,147 | A * | 6/2000 | Tsukamoto | 439/587 |
| 6,371,807 | B1 | 4/2002 | Takagishi et al. | |
| 6,390,848 | B1 * | 5/2002 | Murakami et al. | 439/587 |
| 6,494,731 | B1 * | 12/2002 | Suzuki | 439/275 |
| 6,872,092 | B2 * | 3/2005 | Oka | 439/587 |
| 6,913,486 | B2 * | 7/2005 | Nagayasu et al. | 439/587 |
| 7,033,216 | B2 * | 4/2006 | Ito | 439/587 |
| 7,156,698 | B2 * | 1/2007 | Yamashita | 439/587 |
| 7,273,395 | B2 * | 9/2007 | Hayashi | 439/587 |
| 7,338,319 | B2 * | 3/2008 | Casses et al. | 439/587 |
| 2004/0092163 | A1 | 5/2004 | Nagayasu et al. | |
| 2011/0300731 | A1 * | 12/2011 | Nakamura | 439/271 |

FOREIGN PATENT DOCUMENTS

| | | | |
|---|---|---|---|
| JP | 2004-188909 | A | 7/2004 |
| JP | 2009-054505 | A | 3/2009 |

OTHER PUBLICATIONS

Written Opinion (PCT/ISA/237) of the International Searching Authority, issued in corresponding International Application No. PCT/JP2011/052444 on Mar. 8, 2011.

Extended European Search Report, dated Feb. 10, 2014, issued by the European Patent Office in counterpart European Patent Application No. 11739896.6.

* cited by examiner

CONNECTOR HOUSING WITH MAT SEAL

This application claims the benefit of International Application No. PCT/JP2011/052444 filed Feb. 4, 2011, claiming the benefit of Application No. JP 2010-023118 filed Feb. 4, 2010, in the Japanese Patent Office (JPO), the disclosures of which are incorporated herein in their entirety.

TECHNICAL FIELD

The present invention relates to a connector housing with a mat seal.

BACKGROUND ART

A molded component for a waterproof connector is conventionally known in which a thick, board-like waterproof rubber stopper which is called a mat seal is integrally attached to a connector housing made of hard resin. For example, FIG. 9 is a figure which shows a cross section of a waterproof connector described in a patent document 1.

In the waterproof connector, a mat seal 120 is molded at the back of a connector housing 110, and a terminal 105 is inserted into a terminal accommodating room of the connector housing 110 by passing through a through hole 122 of the mat seal 120. In this way, the internal circumference of the through hole 122 of the mat seal 120 is adhered to the outer circumference of an electric wire 106 which extends from the terminal 105 so that a space between the connector housing 110 and the electric wire 106 is sealed.

CITATION LIST

Patent document

[Patent document 1] Japan Patent Publication No. 2009-54505

SUMMARY OF INVENTION

Technical Problem

When the mat seal 120 is molded integrally with the connector housing 110 with molding processes such as two color molding, gas may be accumulated at the final filling positions of the forming material, and it may be hard for the parts which are essential for the seal performance to be molded into normal shapes.

In view of the above situation, the invention is intended to provide a connector housing with a mat seal which can prevent gas accumulation as much as possible, and it is easy for the parts which are essential for the seal performance to be molded into normal shapes.

Solution to Problem

According to a first invention, there is provided a connector housing with a mat seal, comprising:

a connector housing, made of hard resin, and including a tubular-like hood whose front end is opened, and a rear wall which blocks a back opening of the hood and in which a plurality of terminal insertion holes into which terminals are respectively inserted from a back side are provided; and a mat seal integrally formed with a front surface of the rear wall, by arranging a front mold and a back mold so that the rear wall is sandwiched inside and outside the hood of the connector housing, and injecting silicone gum forming material from a gate which is provided at the back mold into a seal forming cavity which is defined between the rear wall and the front mold, wherein through holes which respectively communicate with the terminal insertion holes of the rear wall of the connector housing are formed in the mat seal, wherein annular seal lips, which are tightly fitted to outer circumferences of electric wires which extend backwards from the terminals which are inserted inside the connector housing by passing through the terminal insertion holes and the through holes, are formed on internal circumferences of the through holes respectively, wherein, at an outer surface of the rear wall of the connector housing, a plurality of passages for the silicone gum forming material, which are separated from each other, are provided outside an area where the plurality of terminal insertion holes are formed, wherein, on the outer surface of the rear wall of the connector housing and outside the passages for the silicone gum forming material, an annular rib is protruded and surrounds an area inside the annular rib, and wherein the mat seal is molded by using the area inside the annular rib as a reservoir space in which the silicone gum forming material which overflows from the seal forming cavity is retained, and among the plurality of passages for the silicone gum forming material, using at least one passage as a passage for a gate through which the silicone gum forming material is injected into the seal forming cavity, and the other passages as passages for overflow.

DESCRIPTION OF EMBODIMENTS

The embodiments of the invention are described with reference to the figures.

A connector housing 1 with a mat seal of an embodiment of the invention is a major component to form a waterproof connector. The waterproof connector includes an outer housing (connector housing) 10 and an inner housing (not shown in the figures) which are molded articles of hard synthetic resin, a mat seal 20 (referred to as an elastic sealing member or a waterproof rubber stopper) which is a molded article of elastomer materials such as rubber, and a plurality of terminals (all are not shown in the figures) which are attached to the front ends of electric wires.

Although not shown in the figures, a plurality of terminal accommodating rooms, into which the terminals which are attached to the front ends of the electric wires can be inserted from the back ends, are provided in the inner housing, and a housing rear wall, in which the back ends of the plurality of the terminal accommodating rooms open, becomes a seal set surface which is adhered to the front surface of the mat seal 20.

Figure 1:
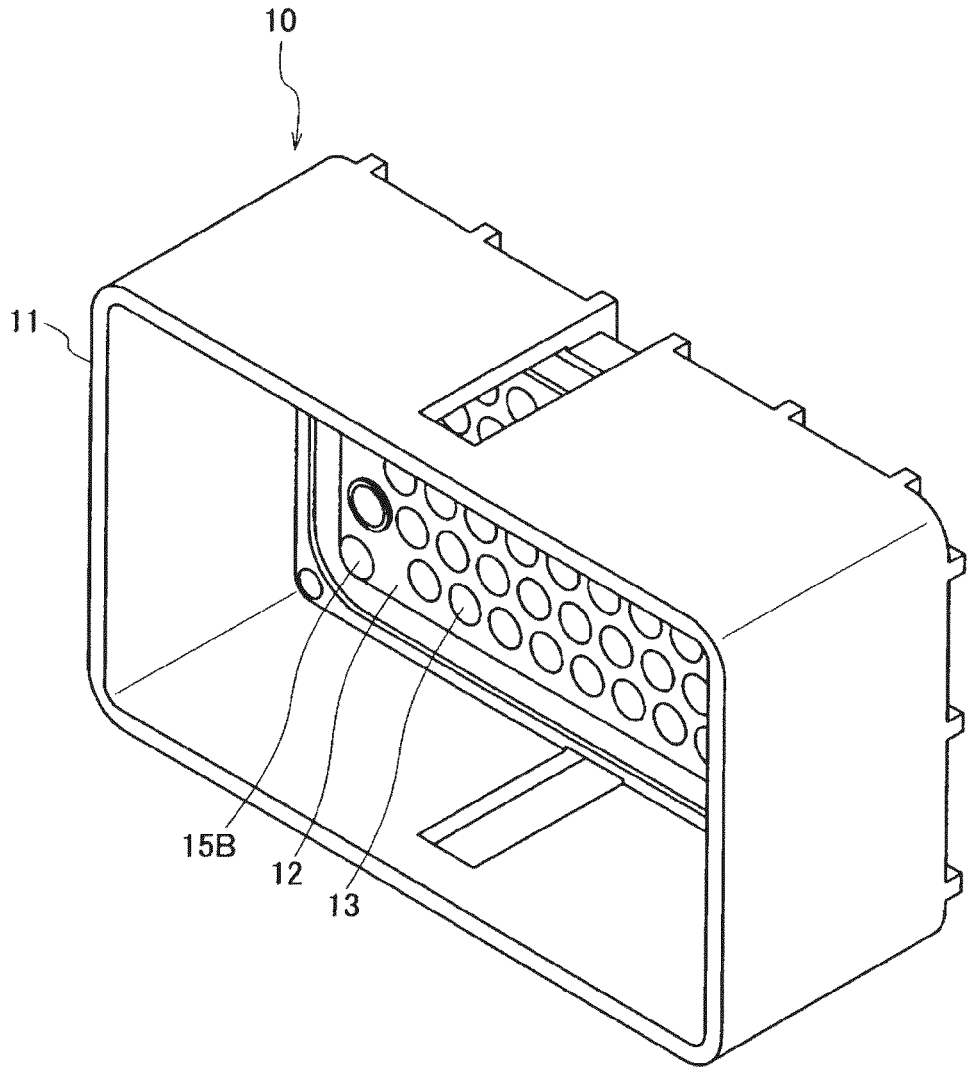
FIG. 1 is a perspective view in which a connector housing itself which forms a connector housing with a mat seal of the invention is seen obliquely from the upper front.
Figure 2:
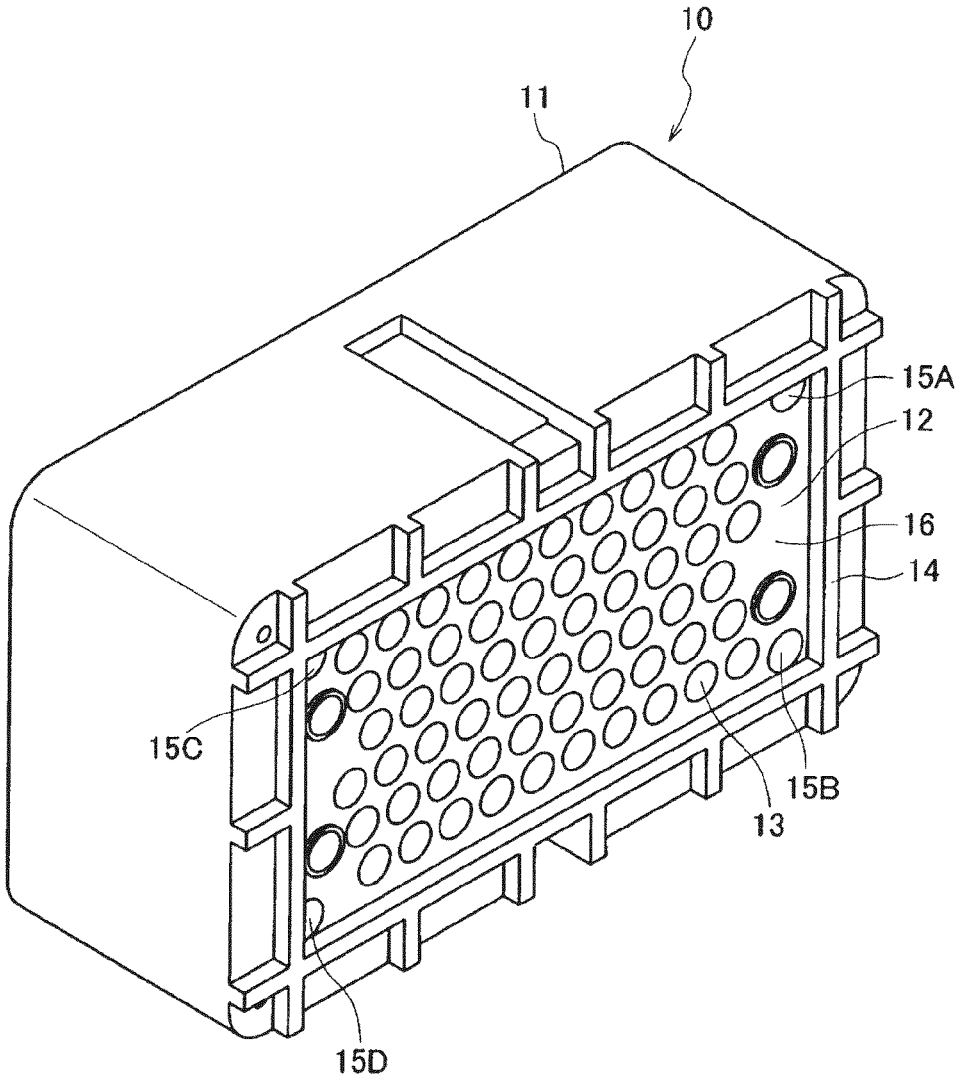
FIG. 2 is a perspective view in which the connector housing of FIG. 1 itself is seen obliquely from the upper back.
Figure 3:
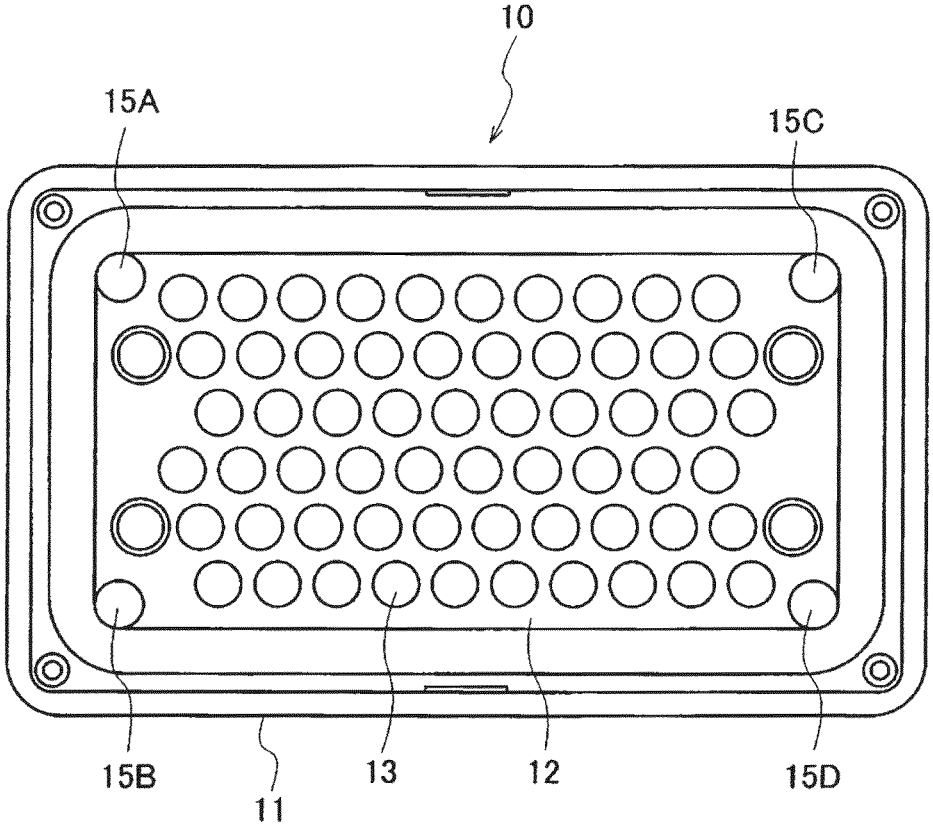
FIG. 3 is a front view of the connector housing of the invention.
Figure 4:
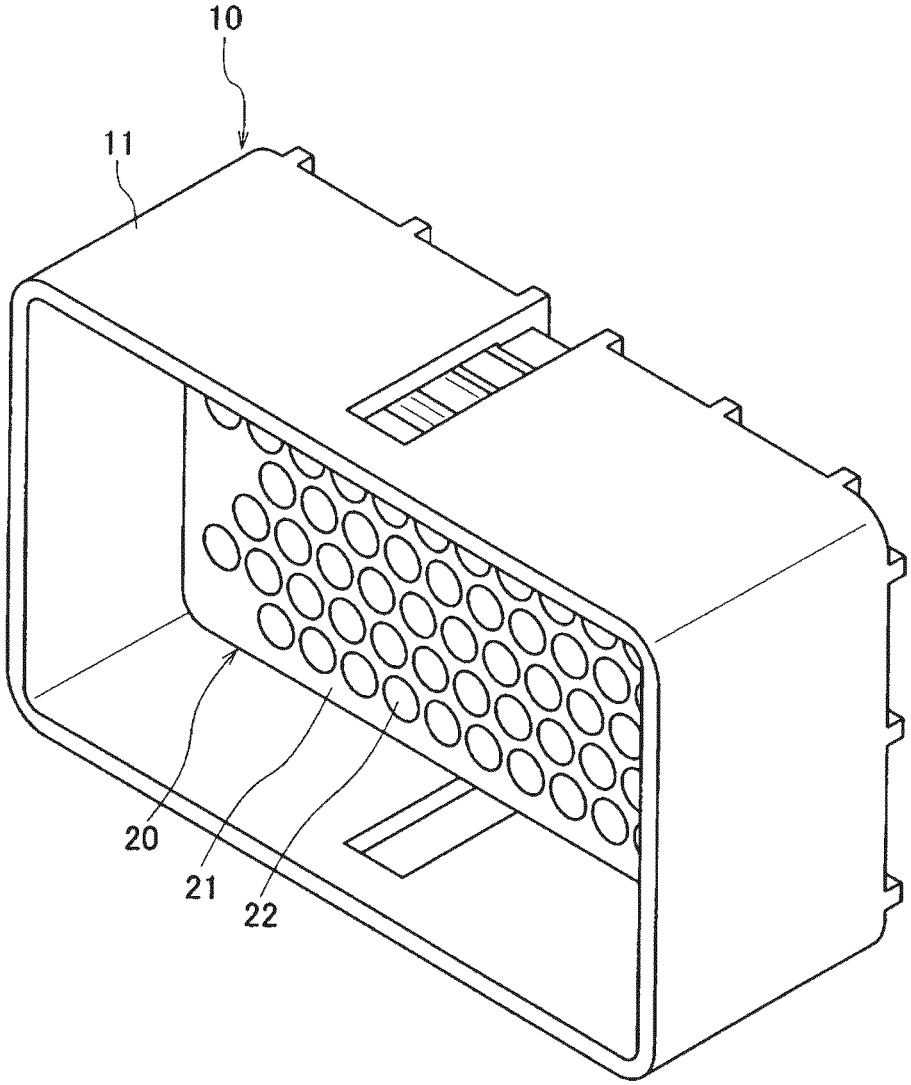
FIG. 4 is a perspective view in which the connector housing with the mat seal, in which the mat seal is integrally molded in the connector housing of FIG. 1, is seen obliquely from the upper front.
Figure 5:
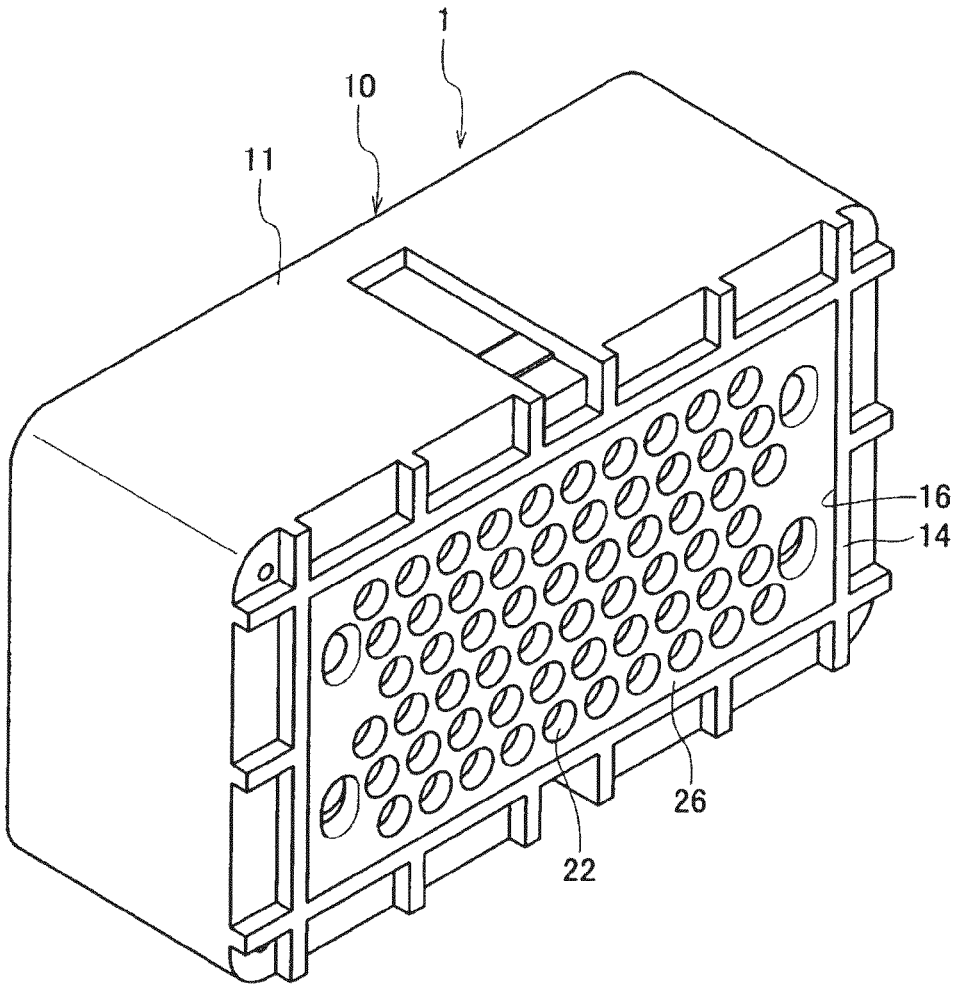
FIG. 5 is a perspective view in which the connector housing with the mat seal of the invention is seen obliquely from the upper back.
Figure 6:
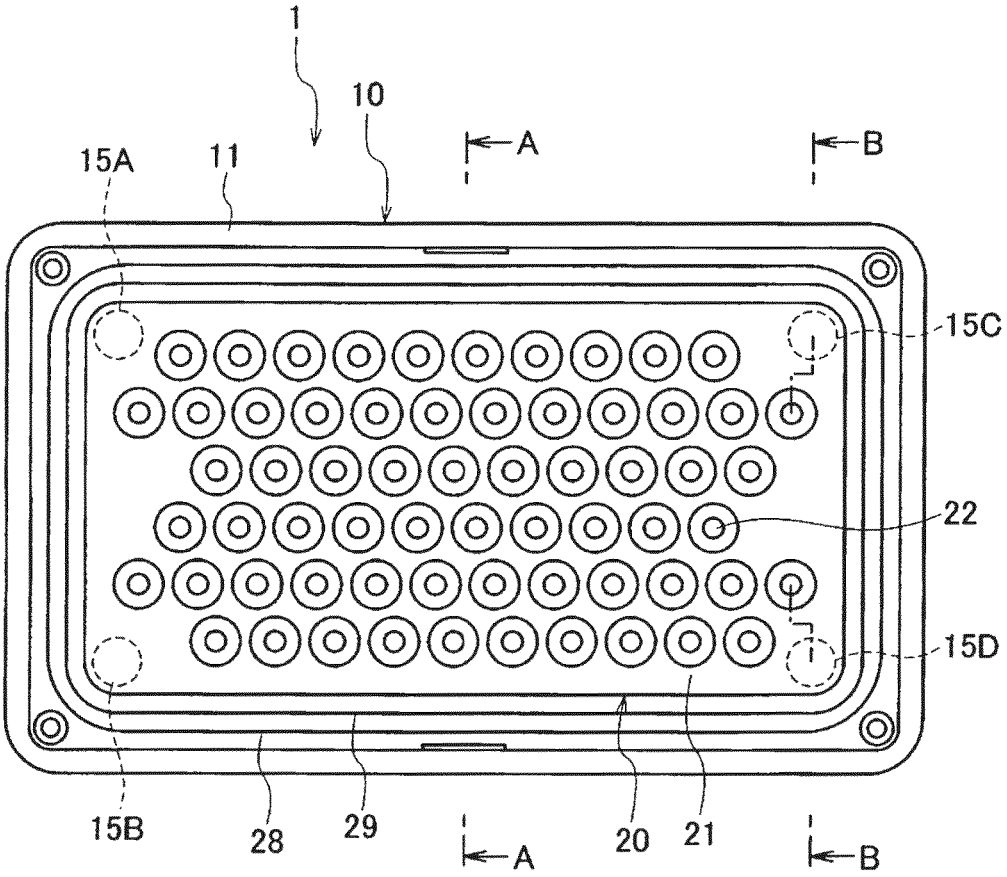
FIG. 6 is a front view of the connector housing with the mat seal of the invention.
Figure 7:
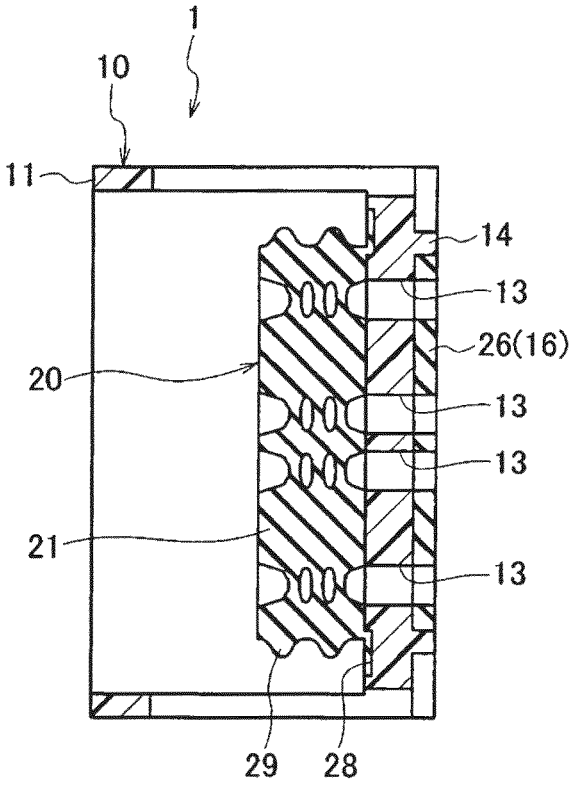
FIG. 7 is a sectional view taken along the line indicated by A-A arrows of FIG. 6.
Figure 8:
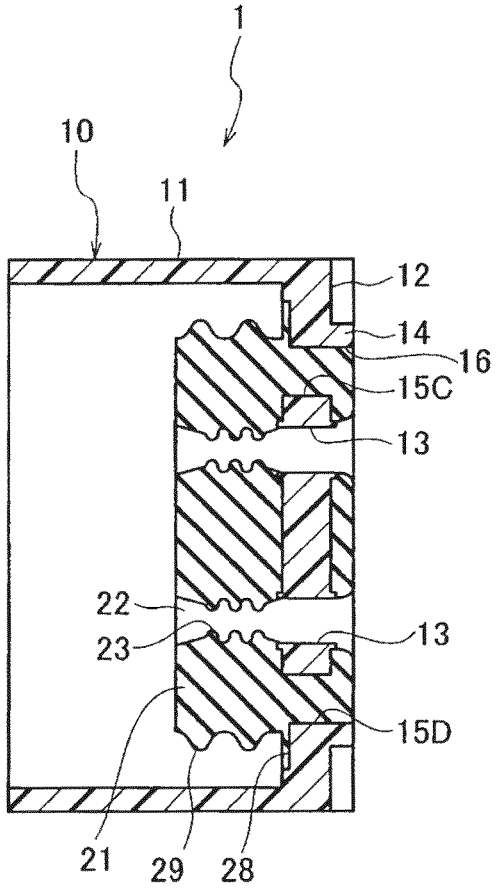
FIG. 8 is a sectional view taken along the line indicated by B-B arrows of FIG. 6.
Figure 9:
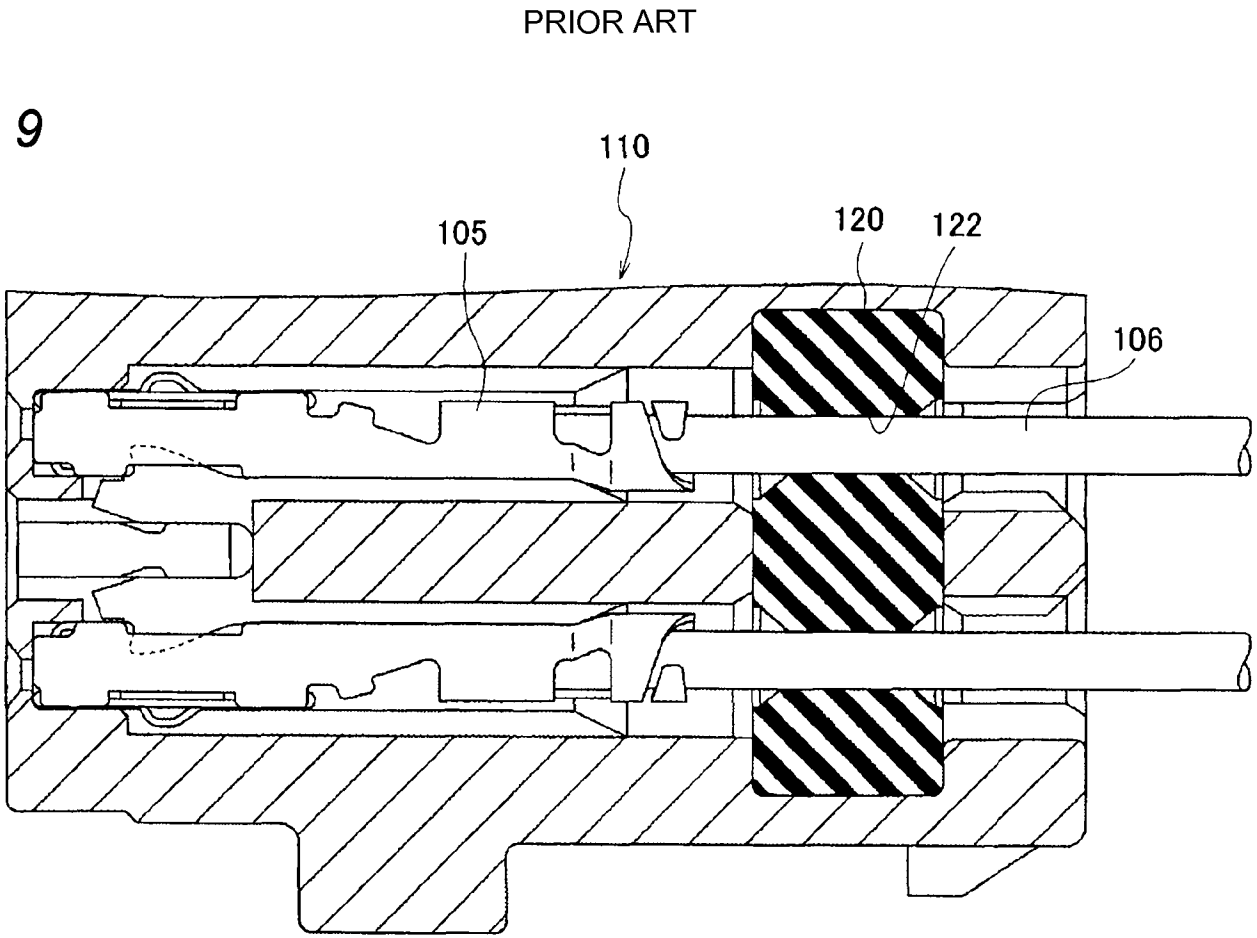
FIG. 9 is a sectional view of a conventional waterproof connector.

As shown in FIGS. 1 to 3, the outer housing 10 has a tubular-like hood 11 whose front end opens and a rear wall 12 which blocks the back opening of the hood 11. Terminal insertion holes 13, which correspond to the terminal accommodating rooms of the inner housing, are formed in the rear wall 12. Thus, the terminals can be inserted into the terminal accommodating rooms of the inner housing by passing through the terminal insertion holes 13.

As shown in FIGS. 4 to 8, because the mat seal 20 is disposed at the back of the outer housing 10 where the electric wires are led out, the mat seal 20 waterproofs between the outer housing 10 and the inner housing and the electric wires. The mat seal 20 is formed integrally with the front surface of the rear wall 12 of the outer housing 10, and the seal set surface at the back of the inner housing is adhered to the front surface of the mat seal 20.

The mat seal 20 is provided with a thick, generally rectangular plate-shaped seal body 21. A plurality of through holes 22, into which the electric wires that pass through the part of the outer housing 10 where the electric wires are led out are respectively inserted, are provided in the seal body 21 and correspond to the terminal insertion holes 13. A plurality of annular internal circumferential lips (annular seal lips) 23 which are spaced in the axial direction and adhered to the outer circumference of the electric wire, are provided on the internal circumferential surface of each of the through holes 22. By using the elasticity of the mat seal 20, the terminals which are attached to the front ends of the electric wires are inserted through the through holes 22 while the through holes 22 are pushed to be wider. After the terminals have passed through the through holes 22, the internal circumferential lips 23 are adhered to the outer circumferences of the electric wires which extend backwards from the terminals. Thus, the gaps between the through holes 22 and the electric wires are sealed. The outer circumference of the seal body 21 of the mat seal 20 is provided with outer circumferential lips 29 which, when a mating connector is engaged, are adhered to the internal circumference of the mating connector housing, and waterproof between the mating connector housing and the inner housing. Burrs 28 are attached to the outer circumference of the seal body 21.

The mat seal 20 is molded by arranging a front mold and a back mold (all of them are not shown in the figures) so that the rear wall 12 is held inside and outside the hood 11 of the outer housing 10, and injecting silicone gum forming material from a gate which is provided at the back mold into a seal forming cavity which is defined between the rear wall 12 and the front mold.

In this case, as shown in FIGS. 1 to 3, at the outer surface of the rear wall 12 of the outer housing 10, a plurality of passages 15A to 15D for the silicone gum forming material, which are separated from each other, are provided outside the area where the plurality of terminal insertion holes 13 are formed. These passages 15A to 15D are arranged at the four corners of the rectangular seal body 21. The shape of these passages 15A to 15D may be circular or square.

On the outer surface of the rear wall 12 of the outer housing 10 and outside these passages 15A to 15D for the silicone gum forming material, an annular rib 14 is protruded and surrounds an area inside. The mat seal 20 is molded by using the area inside the annular rib 14 as a reservoir space 16 in which the forming material 26 which overflows from the seal forming cavity is retained, and among the plurality of passages 15A to 15D for the silicone gum forming material, using one passage 15A as a passage for the gate through which the silicone gum forming material is injected into the seal forming cavity, and the other passages 15B to 15D as passages for overflow.

If the used material is described in detail, the outer housing 10 is molded with injection molding in which melted thermoplastic plastic resin is injected into a mold. The mat seal 20, as described above, is molded by performing two color molding (or insertion molding) based on the molded outer housing 10, and the mat seal 20 are adhered without a gap to the internal surface of the rear wall 12 of the outer housing 10.

Although the thermoplastic plastic resin which forms the outer housing 10 shows adhesivity, the mat seal 20 is molded by using, for example, "liquid silicone gum selectively adhesive material for polyamide resin" (a product number: X-34-1625A/B) manufactured by Shinetsu chemistry Co., Ltd. which is a forming material having selective adhesivity that does not show adhesivity to metal materials (chrome steel) forming the injection molded molds. Thus, the adhesion with the outer housing 10 is carried out at the time of molding, and the outer periphery of the back end surface of the mat seal 20 and the burrs 28 are adhered to the rear wall 12 of the outer housing 10. As the silicone gum forming material, adhesives using silicone gums such as polybutylene terephthalate (PBT), liquid crystal polymer (LCP) and polyphenylene sulfide (PPS) are also effective.

In order to manufacture an integral article of the outer housing 10 and the mat seal 20, first, the outer housing 10 is molded by injecting melted thermoplastic plastic resin into a mold. Then, when the thermoplastic plastic resin of the outer housing 10 is solidified, after the mold for molding the internal surface of the rear wall of the outer housing 10 is replaced with the molds for molding the mat seal 20, liquid silicone gum forming material is injected to the molds.

Since the melting point of the thermoplastic plastic resin which forms the outer housing 10 is set to be higher than the melting point of the silicone gum forming material, the outer housing 10 will not melt when the molding is performed in the above procedure. Since the silicone gum forming material does not show adhesivity to metal of which the molds are formed, the outer housing 10 and the mat seal 20 are removed from the molds without damaging the adhesion positions of the outer housing 10 and the mat seal 20 while the outer periphery of the back end surface of the mat seal 20 and the burrs 28 are adhered to adhesion positions on the inner surface of the rear wall 12 of the outer housing 10.

In this way, after the outer housing 10 and the mat seal 20 which are integrally molded are obtained, the inner housing is inserted into the inside of the outer housing 10 so that the seal set surface at the back of the inner housing is adhered to the front surface of the mat seal 20.

Then, the terminals which are attached to the front ends of the electric wires are inserted through the terminal insertion holes 13 of the outer housing 10 and the through holes 22 of the mat seal 20 and into the terminal accommodating rooms of the inner housing, and the terminals are respectively fixed in the terminal accommodating rooms.

In this case, because the mat seal 20 is integrated with the outer housing 10 beforehand, it becomes easy to handle the components and the mat seal 20 can be held in a stable state. The inner housing, the outer housing 10 and the mat seal 20 also can be smoothly assembled.

Then, a mating connector not shown in the figures is engaged with the waterproof connector of the present embodiment. Thus, the mating connector housing is inserted into the annular space inside the hood 11 of the outer housing 10. At the same time of engaging with the inner housing, the terminals accommodated in the terminal accommodating rooms of the inner housing are engaged with the terminals accommodated in the mating connector housing, and the connection between electric wires is performed.

In such an engaged state, because the internal circumferential lips 23 of the mat seal 20 are elastically adhered to the outer circumferences of the electric wires which are inserted through the through holes 22 of the mat seal 20, water or the like can be surely prevented from entering into the inner housing. Because the outer circumferential lips 29 of the mat seal 20 waterproof between the mating connector housing and the inner housing, the space where the terminals inside the mating connector housing and the terminals inside the inner housing are connected can be surely waterproofed.

The following effects can be achieved by forming the outer housing 10 with the mat seal 20 as above. That is, when the mat seal 20 is molded, since the passage 15A as a gate through which the silicone gum forming material is injected into the seal forming cavity and the passages 15B to 15D for overflow which make the remaining silicone gum forming material overflow outside the cavity are defined, and the reservoir space 16 in which the silicone gum forming material which overflows from the cavity to the outside of the rear wall 12 of the outer housing 10 is retained is defined, there is no need to worry that there are molding defects due to gas accumulation in those parts that are essential for the seal performance of the mat seal 20, the mat seal 20 can be molded easily, and the waterproof reliability can be raised.

The invention is not restricted to the above-described embodiment, and suitable modifications, improvements and the like can be freely made. Moreover, the materials, shapes, dimensions, numerical values, forms, numbers, installation places and the like of the components are arbitrarily set as far as the invention can be attained, and not particularly restricted.

For example, by providing a short shot recognizing window which communicates with the reservoir space 16 of the outer housing 10, it can be recognized whether there are short shots of the silicone gum forming material. If the silicone gum forming material flows into the short shot recognizing window, it is found that the mat seal 20 are surely molded, and there are no molding defects due to gas accumulation in those parts that are essential for the seal performance of the mat seal 20. On the contrary, if the silicone gum forming material does not flow into the short shot recognizing window, it is found that a short shot may occur.

Although the invention is described in detail with reference to specific embodiments, it is apparent that various modifications and amendments may be made by those skilled in the art without departing from the spirit and scope of the invention.

This application is based on the Japanese patent application (patent application 2010-023118) filed on Feb. 4, 2010, whose content is incorporated herein by reference.

INDUSTRIAL APPLICABILITY

According to the first invention, when the mat seal is molded, since the passage as a gate through which the silicone gum forming material is injected into the seal forming cavity and the passages for overflow which make the remaining silicone gum forming material overflow outside the cavity are defined, and the reservoir space in which the silicone gum forming material which overflows from the cavity to the outside of the rear wall of the connector housing is retained is defined, there is no need to worry that there are molding defects due to gas accumulation in those parts that are essential for the seal performance of the mat seal, and the mat seal can be molded easily.

REFERENCE SIGNS LIST

1 Outer Housing with a Mat Seal (Connector Housing with a Mat Seal)
10 Outer Housing (Connector Housing)
11 Hood
12 Rear Wall
13 Terminal Insertion Hole
14 Annular Rib
15A to 15D Passage of Silicone Gum Forming Material
16 Reservoir Space
20 Mat Seal
22 Through Hole
23 Internal Circumferential Lip (Annular Seal Lip)

The invention claimed is:

1. A connector housing with a mat seal, comprising:

a connector housing, made of hard resin, and including a tubular-like hood having a front end being open, and a rear wall provided to block a back opening of the hood, the rear wall having a plurality of terminal insertion holes whereby terminals are respectively inserted from a back side are provided; and a mat seal integrally formed with a front surface of the rear wall, by arranging a front mold and a back mold so that the rear wall is disposed both inside and outside the hood of the connector housing, and injecting silicone gum forming material from a gate which is provided at the back mold into a seal forming cavity, wherein the seal forming cavity is disposed between the rear wall and the front mold, wherein through holes are formed in the mat seal, configured to respectively communicate with the terminal insertion holes of the rear wall of the connector housing, wherein annular seal lips are formed on internal circumferences of the through holes respectively, configured to tightly fit to outer circumferences of electric wires extending backwards from the terminals being inserted inside the connector housing by passing through the terminal insertion holes and the through holes, wherein, at an outer surface of the rear wall of the connector housing, a plurality of passages for the silicone gum forming material, the plurality of passages being separated from each other, are provided outside an area where the plurality of terminal insertion holes are formed, wherein, on the outer surface of the rear wall of the connector housing and outside the passages for the silicone gum forming material, an annular rib is protruded and surrounds an area inside the annular rib, and wherein the mat seal is molded by using the area inside the annular rib as a reservoir space to retain the silicone gum forming material overflowing from the seal forming cavity, and among the plurality of passages for the silicone gum forming material, using at least one passage as a passage for the gate through which the silicone gum forming material is injected into the seal forming cavity, and the other passages as passages for overflow.

* * * * *